US011056268B2

(12) United States Patent
Suzuki et al.

(10) Patent No.: US 11,056,268 B2
(45) Date of Patent: Jul. 6, 2021

(54) COIL COMPONENT

(71) Applicant: TDK CORPORATION, Tokyo (JP)

(72) Inventors: Masanori Suzuki, Tokyo (JP); Kouji Kawamura, Tokyo (JP); Naoaki Fujii, Tokyo (JP); Manabu Yamatani, Tokyo (JP); Tomonaga Nishikawa, Tokyo (JP)

(73) Assignee: TDK CORPORATION, Tokyo (JP)

( * ) Notice: Subject to any disclaimer, the term of this patent is extended or adjusted under 35 U.S.C. 154(b) by 319 days.

(21) Appl. No.: 16/046,586

(22) Filed: Jul. 26, 2018

(65) Prior Publication Data

US 2019/0035534 A1 Jan. 31, 2019

(30) Foreign Application Priority Data

Jul. 28, 2017 (JP) ..... JP2017-146677

(51) Int. Cl.

| | |
|---|---|
| ***H01F 27/28*** | (2006.01) |
| ***H01F 27/32*** | (2006.01) |
| ***H01F 41/12*** | (2006.01) |
| ***H01F 41/04*** | (2006.01) |
| ***H01F 17/00*** | (2006.01) |

(Continued)

(52) U.S. Cl.

CPC ..... *H01F 27/2804* (2013.01); *H01F 17/0013* (2013.01); *H01F 17/04* (2013.01); *H01F 27/323* (2013.01); *H01F 41/043* (2013.01); *H01F 41/122* (2013.01); *H01F 27/29* (2013.01); *H01F 27/292* (2013.01); *H01F 2017/048* (2013.01); *H01F 2027/2809* (2013.01)

(58) Field of Classification Search

CPC ..... H01F 27/2804; H01F 2027/2809; H01F 17/0006; H01F 17/0013; H01F 2017/0066; H01F 27/24; H01F 17/04; H01F 17/0033; H01F 2017/0073; H01F 2017/048; H01F 27/292; H01F 27/255; H01F 27/245

USPC ..... 336/200, 232

See application file for complete search history.

(56) References Cited

U.S. PATENT DOCUMENTS 5,349,743 A 9/1994 Grader et al.
5,572,179 A 11/1996 Ito et al.

(Continued)

FOREIGN PATENT DOCUMENTS

JP 2005191191 A * 7/2005
JP 2006-041184 A 2/2006

(Continued)

*Primary Examiner* — Tszfung J Chan

(74) *Attorney, Agent, or Firm* — Oliff PLC

(57) ABSTRACT

A coil component includes a plurality of conductor layers constituted of a first conductor layer to a fourth conductor layer that includes a function layer and a coil layer wound around an axis center; and a covering portion that is formed of an insulative resin, integrally covers the plurality of conductor layers, and is interposed between conductor layers adjacent to each other. The coil layer and the function layer of the plurality of conductor layers have substantially the same shape in a plan view. The fourth conductor layer has a connection conductor layer connecting the coil layer and the function layer to each other. A conductor layer having no connection conductor layer among the plurality of conductor layers has a protrusion portion corresponding to the connection conductor layer at a position overlapping the connection conductor layer in a plan view.

9 Claims, 4 Drawing Sheets

(51) Int. Cl.
*H01F 17/04* (2006.01)
*H01F 27/29* (2006.01)

(56) References Cited

U.S. PATENT DOCUMENTS

| | | | | |
|---|---|---|---|---|
| 6,073,339 | A * | 6/2000 | Levin | H01F 17/0013 29/602.1 |
| 6,222,425 | B1 | 4/2001 | Okada et al. | |
| 2004/0257748 | A1 | 12/2004 | Ritter et al. | |
| 2007/0040163 | A1 | 2/2007 | Okuzawa et al. | |
| 2010/0157565 | A1 | 6/2010 | Yoshida et al. | |
| 2011/0007439 | A1 | 1/2011 | Asakawa et al. | |
| 2012/0133472 | A1 | 5/2012 | Nishikawa et al. | |
| 2013/0152379 | A1 | 6/2013 | Lee et al. | |
| 2014/0139307 | A1 | 5/2014 | Kido et al. | |
| 2014/0292466 | A1 | 10/2014 | Watanabe et al. | |
| 2014/0308795 | A1 | 10/2014 | Holland et al. | |
| 2015/0145627 | A1 | 5/2015 | Sim et al. | |
| 2015/0357115 | A1 | 12/2015 | Ohkubo et al. | |
| 2016/0104565 | A1 | 4/2016 | Nishiyama | |
| 2016/0247630 | A1 | 8/2016 | Kido et al. | |
| 2017/0111995 | A1 | 4/2017 | Nishikawa et al. | |
| 2017/0229247 | A1 * | 8/2017 | Yoneda | H01G 4/232 |

FOREIGN PATENT DOCUMENTS

| | | | |
|---|---|---|---|
| JP | 2014229739 | A * | 12/2014 |
| JP | 2015-130472 | A | 7/2015 |
| JP | 2017-079216 | A | 4/2017 |

* cited by examiner

COIL COMPONENT

TECHNICAL FIELD

The present invention relates to a coil component.

BACKGROUND

As coil components used as electronic components mounted in switching power supplies or the like, for example, as disclosed in Japanese Unexamined Patent Publication No. 2017-79216, a coil component in which conductor layers forming a coil pattern and insulative resin layers are alternately laminated is known.

SUMMARY

However, in a coil component in which conductor layers and insulative resin layers are alternately laminated, there is a possibility that unevenness will occur in the insulative resin layers due to contraction of the insulative resin layers incidental to hardening at the time of production. In this case, there is a possibility that disconnection will occur in the conductor layers particularly related to a wiring different from a coil, affected by unevenness of the insulative resin layers.

The present invention has been made in consideration of the foregoing circumstances, and an object thereof is to provide a coil component in which disconnection in a conductor layer related to a wiring can be minimized.

In order to achieve the object described above, according to an aspect of the present invention, there is provided a coil component including a plurality of conductor layers that are laminated in a lamination direction and includes a function layer and a coil layer wound around an axis center; and a covering portion that is formed of an insulative resin, integrally covers the plurality of conductor layers, and is interposed between conductor layers adjacent to each other. The coil layer and the function layer of the plurality of conductor layers have substantially the same shape in a plan view. A part of conductor layers among the plurality of conductor layers has a connection conductor layer connecting the coil layer and the function layer to each other. A conductor layer having no connection conductor layer among the plurality of conductor layers has a protrusion portion corresponding to the connection conductor layer at a position overlapping the connection conductor layer in a plan view.

According to the coil component, when the connection conductor layer connecting the coil layer and the function layer to each other is provided in a part of the plurality of conductor layers including the coil layer and the function layer, the protrusion portion corresponding to the connection conductor layer is provided at a position overlapping the connection conductor layer in a plan view in the conductor layer having no connection conductor layer. Since the coil component has such a structure, unevenness, distortion, or the like incidental to contraction of the insulative resin forming the covering portion can be prevented from being concentrated in the connection conductor layer connecting the coil layer and the function layer. Therefore, disconnection in a conductor layer related to a wiring can be minimized.

Here, a conductor layer below the conductor layer in which the connection conductor layer is formed among the plurality of conductor layers may be configured to have the protrusion portion.

When the conductor layer having no connection conductor layer is located below the conductor layer in which the connection conductor layer is provided, disconnection affected by the insulative resin on a lower side is likely to occur in the connection conductor layer. In contrast, when the conductor layer on a lower side is configured to have the protrusion portion, disconnection in the connection conductor layer on an upper side can be suitably prevented.

In addition, all of the conductor layers below the conductor layer in which the connection conductor layer is formed among the plurality of conductor layers may be configured to have the protrusion portion.

As described above, when all of the conductor layers below the conductor layer having the connection conductor layer are configured to have the protrusion portion, disconnection in the connection conductor layer on an upper side can be more suitably prevented.

In addition, a conductor layer above the conductor layer in which the connection conductor layer is formed among the plurality of conductor layers may be configured to have the protrusion portion.

When the conductor layer having no connection conductor layer having no connection conductor layer is located above the conductor layer in which the connection conductor layer is provided, disconnection affected by the insulative resin on an upper side is likely to occur. In contrast, when a conductor layer on an upper side is configured to have the protrusion portion, disconnection in the connection conductor layer derived from the insulative resin on an upper side can be suitably prevented.

In addition, the protrusion portion may be configured to be formed to protrude from the coil layer.

As described above, when the protrusion portion is configured to be formed to protrude from the coil layer, the protrusion portion contributes to reducing a resistance value of the coil layer, and thus characteristics of the coil layer can be improved.

In addition, the protrusion portion may be configured to be formed to protrude from the function layer.

As described above, when the protrusion portion is configured to be formed to protrude from the function layer, characteristics of the function layer can be improved due to the protrusion portion.

According to the present invention, a coil component in which disconnection in a conductor layer related to a wiring can be minimized is provided.

DETAILED DESCRIPTION

Hereinafter, an embodiment will be described in detail with reference to the drawings. In each of the drawings, the same reference signs are applied to the same parts or corresponding parts, and duplicated description will be omitted.

Figure 1:
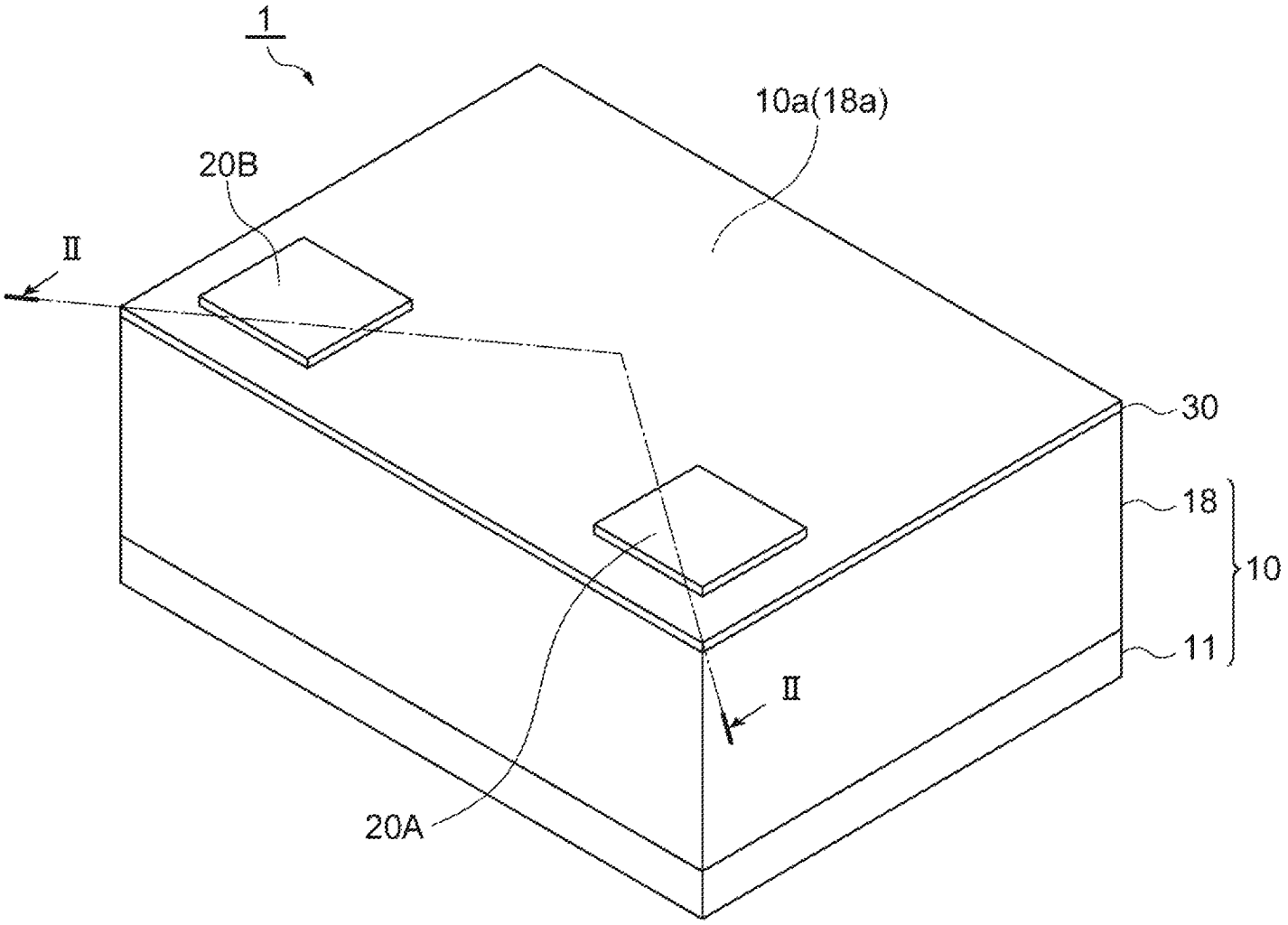
FIG. 1 is a perspective view of a coil component according to an embodiment of the present invention.
Figure 2:
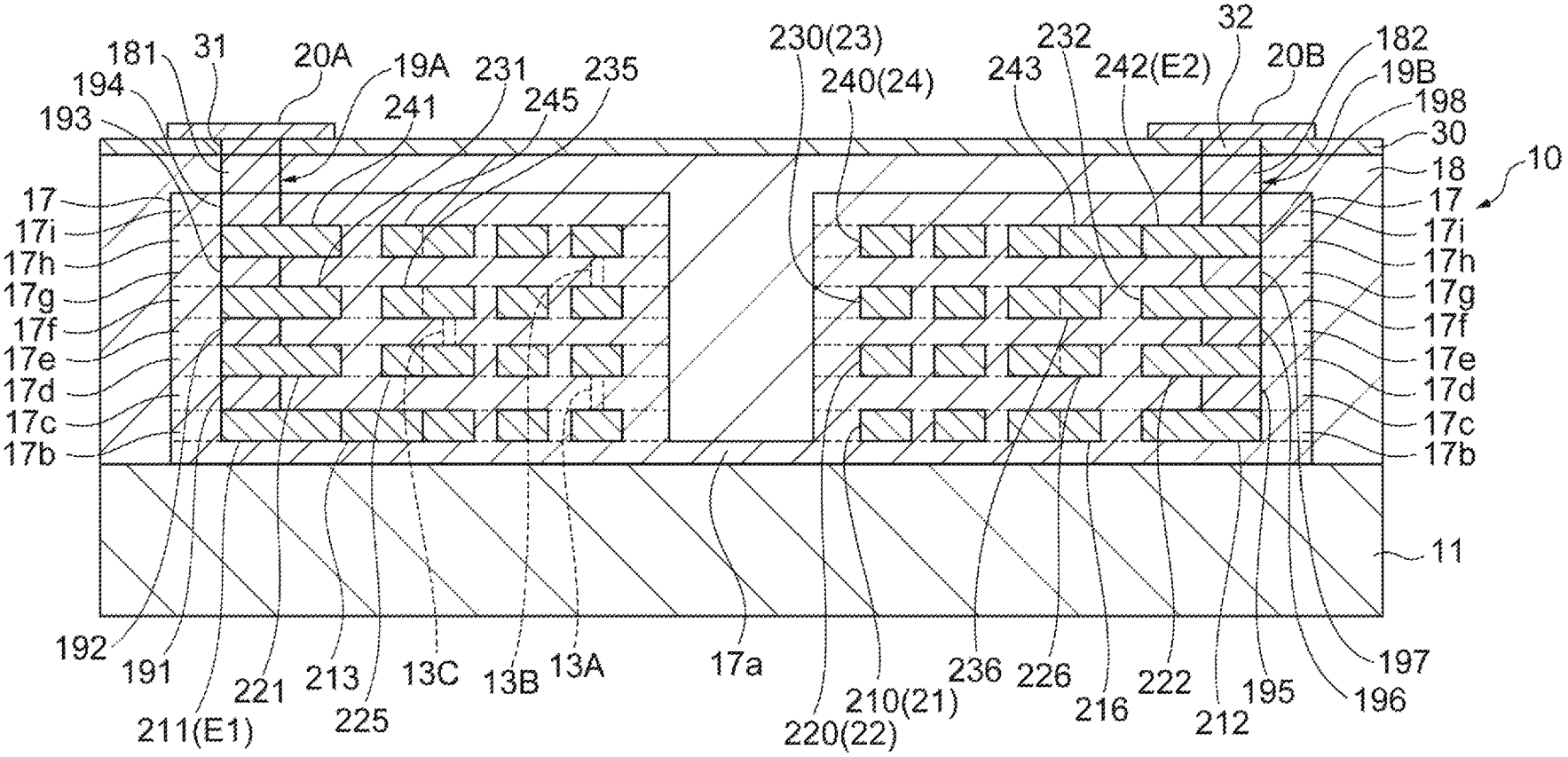
FIG. 2 is a cross-sectional view taken along line II-II in FIG. 1.

With reference to FIGS. 1 to 4D, a schematic configuration of a coil component 1 according to an embodiment of the present invention will be described. FIG. 1 is a perspective view of the coil component 1. FIG. 2 is a cross-sectional view taken along line II-II in FIG. 1. FIGS. 3A to 3D and FIGS. 4A to 4D are plane pattern diagrams for describing a production step for the coil component 1.

As illustrated in FIG. 1, the coil component 1 includes an element body 10 (magnetic element body) which is internally provided with a coil 12 (which will be described below), and an insulative layer 30 which is provided on a main surface 10*a* of the element body 10. The element body 10 has a rectangular parallelepiped exterior. Examples of the rectangular parallelepiped shape include a rectangular parallelepiped shape having chamfered corners and ridge portions, and a rectangular parallelepiped shape having rounded corners and ridge portions. The main surface 10*a* of the element body 10 is formed into a rectangular shape having long sides and short sides. Examples of the rectangular shape include a rectangle having rounded corners.

Terminal electrodes 20A and 20B are provided on the main surface 10*a* of the element body 10 with the insulative layer 30 interposed therebetween. The terminal electrode 20A is provided on one short side of the main surface 10*a*, and the terminal electrode 20B is provided on the other short side of the main surface 10*a*. In addition, the terminal electrodes 20A and 20B are separated from each other in a direction along the long side on the main surface 10*a*.

For example, the element body 10 is formed of a magnetic material. Specifically, the element body 10 is constituted of a magnetic substrate 11 and a magnetic resin layer 18.

The magnetic substrate 11 is a substantially flat substrate formed of a magnetic material. The magnetic substrate 11 is positioned on a side opposite to the main surface 10*a* in the element body 10. The magnetic resin layer 18 and a coil portion C constituted of the coil 12 (which will be described below) are provided on a main surface 11*a* of the magnetic substrate 11.

Specifically, the magnetic substrate 11 is formed of a ferrite material (for example, a Ni—Zn-based ferrite material). In the present embodiment, a ferrite material forming the magnetic substrate 11 includes $Fe_2O_3$, NiO, and ZnO as main materials and includes TiO, CoO, $Bi_2O_3$, and $Ca_2O_3$ as additives.

The magnetic resin layer 18 is formed on the magnetic substrate 11 and is internally provided with the coil 12 (which will be described below). A surface of the magnetic resin layer 18 on a side opposite to the surface on the magnetic substrate 11 side constitutes the main surface 10*a* of the element body 10. The magnetic resin layer 18 is a mixture of magnetic powder and a binder resin. Examples of the constituent material of the magnetic powder include iron, carbonyl iron, silicon, cobalt, chromium, nickel, and boron. Examples of the constituent material of the binder resin include an epoxy resin. For example, 90% or more of the magnetic resin layer 18 in its entirety may be formed of magnetic powder.

Each of a pair of terminal electrodes 20A and 20B provided on the main surface 10*a* of the element body 10 has a film shape. For example, the terminal electrodes 20A and 20B are formed of a conductive material such as Cu. In the present embodiment, the terminal electrodes 20A and 20B are plating electrodes formed through plating forming. The terminal electrodes 20A and 20B may have a single layer structure or a multi-layer structure. In a plan view, forming regions of the terminal electrodes 20A and 20B and forming regions of lead-out conductors 19A and 19B overlap each other by 50% or more.

The element body 10 of the coil component 1 internally (specifically, inside the magnetic resin layer 18) has the coil 12, a covering portion 17, and the lead-out conductors 19A and 19B.

The coil 12 is a planar coil located along a normal direction of the main surface 10*a* of the element body 10. For example, the coil 12 is formed of a metal material such as Cu. In the present embodiment, the coil 12 is constituted of four coil conductor layers. A first coil layer 210 included in a first conductor layer 21, a second coil layer 220 included in a second conductor layer 22, a third coil layer 230 included in a third conductor layer 23, and a fourth coil layer 240 included in a fourth conductor layer 24 are laminated in this order in a direction orthogonal to the main surface 10*a* (axis center direction of the coil 12). That is, a direction orthogonal to the main surface 10*a* is a lamination direction of the first conductor layer 21, the second conductor layer 22, the third conductor layer 23, and the fourth conductor layer 24.

The first conductor layer 21 includes electrode conductor layers 211 and 212 and a connection conductor layer 213 in addition to the first coil layer 210. The second conductor layer 22 includes electrode conductor layers 221 and 222 in addition to the second coil layer 220. The third conductor layer 23 includes electrode conductor layers 231 and 232 in addition to the third coil layer 230. The fourth conductor layer 24 includes electrode conductor layers 241 and 242 and a connection conductor layer 243 in addition to the fourth coil layer 240. Each of the electrode conductor layers and each of the connection conductor layers will be described below.

For example, the thicknesses of the first conductor layer 21 to the fourth conductor layer 24 approximately range from 35 μm to 100 μm. The thicknesses of the first coil layer 210 to the fourth coil layer 240 may be the same as each other or may be different from each other. In addition, for example, the coil widths (conductor widths) of the first coil layer 210 to the fourth coil layer 240 approximately range from 10 μm to 150 μm. For example, the coil wire intervals (gap interval between a conductor and another conductor) of the first coil layer 210 to the fourth coil layer 240 approximately range from 10 μm to 40 μm. The coil widths and the coil wire intervals of the first coil layer 210 to the fourth coil layer 240 may also be the same as each other or may be different from each other, similar to the thicknesses. For example, the sizes (exterior sizes) of the first coil layer 210 to the fourth coil layer 240 in a plan view (that is, when seen in a coil axis line direction) approximately range from 40 μm to 120 μm.

Figure 3A:
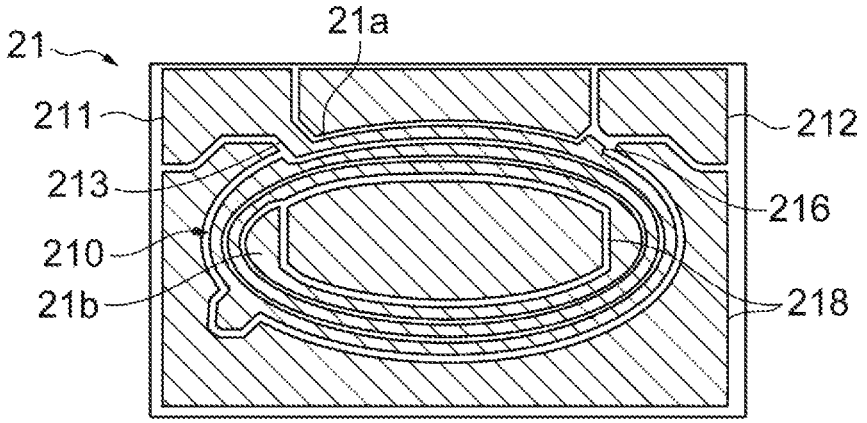
FIGS. 3A, 3B, 3C, 3D are plane pattern diagrams for describing a production step for a coil component.

Each of the coil layers 210 to 240 forming the coil 12 has a plurality of windings. In the present embodiment, each of the coil layers 210 to 240 is wound approximately three windings. For example, as illustrated in FIG. 3A and the like, each of the coil layers (which will be described below in detail) is wound into a substantially elliptic ring shape in a plan view (that is, when seen in the coil axis line direction). Therefore, the coil 12 has a substantially elliptic ring-shaped winding region (region in which a conductor is wound) in a plan view. Then, its axis center (coil axis) extends along the normal direction of the main surface 11*a* of the magnetic substrate 11 and the main surface 10*a* of the element body 10 (direction orthogonal to the main surface 11*a* and the main surface 10*a* of the element body 10).

All of the first coil layer 210 to the fourth coil layer 240 have the same winding direction, and a current flows in the same direction (for example, the clockwise direction) at a predetermined timing. The first coil layer 210 to the fourth coil layer 240 have the winding regions with substantially the same shape in a plan view (that is, when seen in the coil axis line direction), and these overlap each other.

In addition, a joining portion 13A is provided between the first coil layer 210 and the second coil layer 220. A joining portion 13B is provided between the second coil layer 220 and the third coil layer 230. A joining portion 13C is provided between the third coil layer 230 and the fourth coil layer 240. In FIG. 2, the joining portions 13A to 13C are illustrated with dotted lines as references.

The joining portion 13A is interposed between the first coil layer 210 and the second coil layer 220 and joins the innermost winding of the first coil layer 210 and the innermost winding of the second coil layer 220 to each other. The joining portion 13B is interposed between the second coil layer 220 and the third coil layer 230 and joins the outermost winding of the second coil layer 220 and the outermost winding of the third coil layer 230 to each other. The joining portion 13C is interposed between the third coil layer 230 and the fourth coil layer 240 and joins the innermost winding of the third coil layer 230 and the innermost winding of the fourth coil layer 240 to each other.

The covering portion 17 has insulation properties and is formed of an insulative resin. For example, examples of the insulative resin used for the covering portion 17 include polyimide and polyethylene terephthalate. Inside the element body 10, the covering portion 17 integrally covers the first conductor layer 21 to the fourth conductor layer 24 including the first coil layer 210 to the fourth coil layer 240 of the coil 12, and the covering portion 17 is interposed between conductor layers adjacent to each other. In the present embodiment, the covering portion 17 has a lamination structure constituted of nine insulative resin layers 17*a*, 17*b*, 17*c*, 17*d*, 17*e*, 17*f*, 17*g*, 17*h*, and 17*i*.

The insulative resin layer 17*a* is positioned on a lower side of the first coil layer 210 (magnetic substrate 11 side) and is formed in a region substantially the same as the forming region of the coil 12 in a plane view. The insulative resin layer 17*b* fills the periphery and gaps between the windings within the same layer as the first coil layer 210, and an opening is formed in a region corresponding to the inner diameter of the coil 12. The insulative resin layer 17*b* fills the first coil layer 210, the periphery, and gaps between the windings within the same layer as the first coil layer 210, and an opening is formed in a region corresponding to the inner diameter of the coil 12. The insulative resin layer 17*c* is located at a position interposed between the first coil layer 210 and the second coil layer 220, and an opening is formed in a region corresponding to the inner diameter of the coil 12. Similarly, the insulative resin layers 17*d*, 17*f*, and 17*h* fill the periphery and gaps between the windings of the coil layers within the same layer of the second coil layer 220, the third coil layer 230, and the fourth coil layer 240 respectively, and an opening is formed in a region corresponding to the inner diameter of the coil 12. The insulative resin layers 17*e* and 17*g* are located at positions interposed between the second coil layer 220 and the third coil layer 230, and between the third coil layer 230 and the fourth coil layer 240 respectively, and an opening is formed in a region corresponding to the inner diameter of the coil 12. The insulative resin layer 17*g* is positioned on an upper side (main surface 10*a* side) of the fourth coil layer 240 and covers the fourth coil layer 240, and an opening is formed in a region corresponding to the inner diameter of the coil 12. For example, the thickness of the insulative resin layer 17*a* can range from 3 μm to 10 μm. In addition, the thicknesses of the insulative resin layers 17*b*, 17*d*, 17*f*, and 17*h* are the same as those of the first coil layer 210 to the fourth coil layer 240, for example, approximately ranging from 5 μm to 30 μm. In addition, for example, the thicknesses of the insulative resin layers 17*c*, 17*e*, 17*g*, and 17*i* approximately range from 5 μm to 30 μm.

In the present embodiment, the coil portion C is constituted of the coil 12 and the covering portion 17 described above.

For example, a pair of lead-out conductors 19A and 19B are formed of Cu and extend from each of both end portions E1 and E2 of the coil 12 along a direction orthogonal to the main surface 10*a*.

The lead-out conductor 19A is connected to the end portion E1 of the coil 12 provided in the outermost winding of the first coil layer 210. The lead-out conductor 19A penetrates the covering portion 17 and the magnetic resin layer 18 and extends from the end portion E1 of the coil 12 to the main surface 10*a* of the element body 10, thereby being exposed on the main surface 10*a*. The terminal electrode 20A is provided at a position corresponding to an exposed part of the lead-out conductor 19A. The lead-out conductor 19A is connected to the terminal electrode 20A by a conductor portion 31 inside a penetration hole of the insulative layer 30. Accordingly, the end portion E1 of the coil 12 and the terminal electrode 20A are electrically connected to each other with the lead-out conductor 19A interposed therebetween.

More specifically, the end portion E1 of the coil 12 provided at an outer circumferential end 21*a* which is the outermost winding of the first coil layer 210 is provided at a position protruding from the winding region wound into a substantially elliptic ring shape. Then, the lead-out conductor 19A is formed by combining the electrode conductor layers 221, 231, and 241 formed in the second coil layer 220 to the fourth coil layer 240 positioned above the end portion E1, conductor layers 191 to 194 formed in the openings provided in the insulative resin layers 17*c*, 17*e*, 17*g*, and 17*i*, and a conductor layer 181 formed in the opening provided in the magnetic resin layer 18.

In addition, the lead-out conductor 19B is connected to one end portion E2 of the coil 12 provided at an outer circumferential end 24*a* of the outermost winding of the fourth coil layer 240. The lead-out conductor 19B extends from the end portion E2 of the coil 12 to the main surface 10*a* of the element body 10 in a manner penetrating the magnetic resin layer 18 and the insulative resin layer 17*i*, thereby being exposed on the main surface 10*a*. The terminal electrode 20B is provided at a position corresponding to an exposed part of the lead-out conductor 19B. The lead-out conductor 19B is connected to the terminal electrode 20A by a conductor portion 32 inside the penetration hole of the insulative layer 30. Accordingly, the end portion E2 of the coil 12 and the terminal electrode 20B are electrically connected to each other with the lead-out conductor 19B and the conductor portion 32 interposed therebetween.

More specifically, the end portion E2 of the coil 12 provided in the fourth coil layer 240 is provided at a position protruding from the region wound into a substantially elliptic ring shape. Then, the lead-out conductor 19B is formed by a conductor layer 198 formed in the opening provided in the insulative resin layer 17*i* of the covering portion 17 positioned above the end portion E2, and a conductor layer 182 formed in the opening provided in the magnetic resin layer 18 above the end portion E2. Moreover, the lead-out conductor 19B is also connected to the electrode conductor layers 212, 232, and 242 formed in the first coil layer 210 to the third coil layer 230 positioned below the end portion E2, and conductor layers 195 to 197 formed in the openings provided in the insulative resin layers 17*c*, 17*e*, and 17*g*. That is, the lead-out conductor 19B also includes the electrode conductor layers 212, 232, 242, and 195 to 197.

The insulative layer 30 provided on the main surface 10*a* of the element body 10 is interposed between the pair of terminal electrodes 20A and 20B on the main surface 10*a*. In the present embodiment, the insulative layer 30 is provided to cover the entire region of the main surface 10*a* in a manner exposing the pair of lead-out conductors 19A and 19B and includes a part which extends in a direction intersecting a long side direction (direction in which the pair of terminal electrodes 20A and 20B are adjacent to each other) and traverses the main surface 10*a*. The insulative layer 30 has penetration holes 31 and 32 at positions corresponding to the lead-out conductors 19A and 19B. A conductor portion formed of a conductive material such as Cu is provided inside the penetration hole. The insulative layer 30 is formed of an insulative material. For example, the insulative layer 30 is formed of an insulative resin such as polyimide or epoxy.

Next, a production method for the coil component 1 will be described with reference to FIGS. 3A to 3D and FIGS. 4A to 4D. FIGS. 3A to 3D and 4A to 4D are plane pattern diagrams for describing the production step for the coil component 1.

First, a magnetic substrate 11 formed of sintered ferrite or the like having a predetermined thickness is prepared. The insulative resin layer 17*a* is formed on an upper surface of the magnetic substrate 11. Specifically, the upper surface of the magnetic substrate 11 is coated with a resin material through a spin coating method and is hardened. Thereafter, a predetermined pattern is formed through a photolithographic method.

Next, as illustrated in FIG. 3A, the first coil layer 210, the electrode conductor layers 211 and 212, and the connection conductor layer 213 included in the first conductor layer 21 are formed on the upper surface of the insulative resin layer 17*a*. The electrode conductor layer 211 provided on an outer side of the outer circumferential end 21*a* of the first coil layer 210 is a region functioning as the end portion E1 of the coil 12. In addition, the electrode conductor layer 212 has a shape corresponding to the end portion E2 of the coil 12 (which will be described below). In addition, the connection conductor layer 213 is a conductor layer connecting the electrode conductor layer 211 and the outer circumferential end 21*a* of the first coil layer 210 to each other. In addition to the conductor layers described above, conductor layers 218 are also formed on an inner side and the periphery of the first coil layer 210. The conductor layers 218 are removed at a production stage for the coil component 1. As a forming method for these conductors, it is preferable that a base metal film be formed by using a thin film process such as a sputtering method, and then the base metal film be subjected to plating growth to a desired film thickness by using an electro-plating method.

Figure 3B:
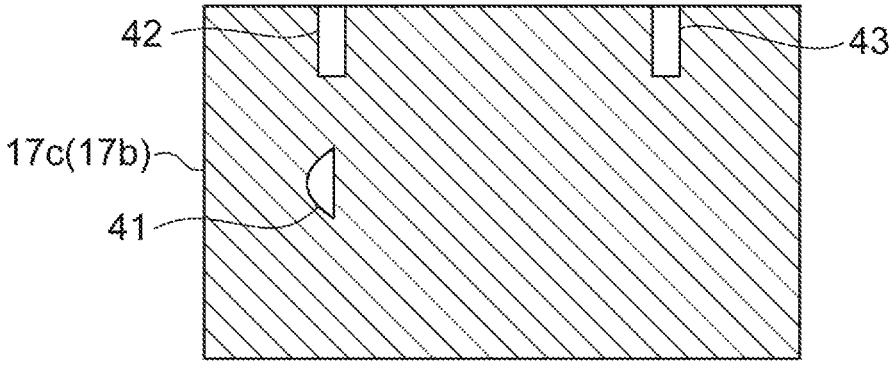

Next, as illustrated in FIG. 3B, an insulative resin is laminated on the upper surface of the insulative resin layer 17*a* such that the first coil layer 210, the electrode conductor layers 211 and 212, and the connection conductor layer 213 are covered, thereby forming the insulative resin layer 17*b* on the periphery of the first coil layer 210 and the electrode conductor layers 211 and 212, and the insulative resin layer 17*c* on the upper surface thereof. The forming method is similar to that for the insulative resin layer 17*a*. After being coated with a resin material through the spin coating method and being hardened, a predetermined pattern is formed through the photolithographic method. An opening 41 illustrated in FIG. 3B is formed at a position exposing an inner circumferential end 21*b* on the opposite side of one end portion of the first coil layer 210 forming the end portion E1 of the coil 12. In addition, openings 42 and 43 are formed at positions exposing the electrode conductor layers 211 and 212 respectively.

Figure 3C:
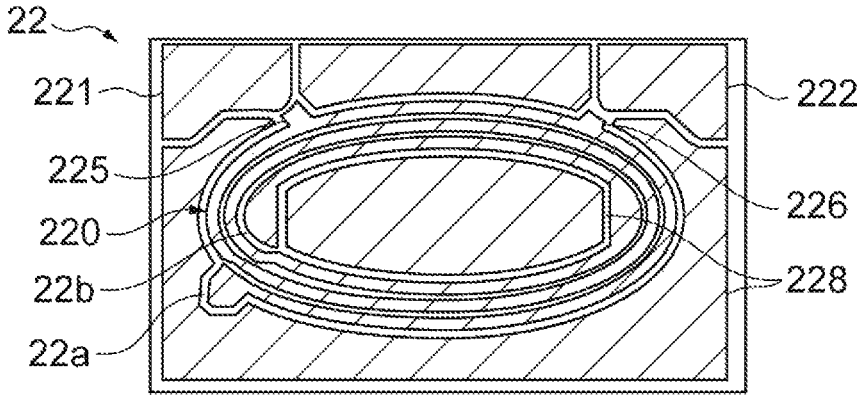

Next, as illustrated in FIG. 3C, the second coil layer 220 and the electrode conductor layers 221 and 222 included in the second conductor layer 22 are formed on the upper surface of the insulative resin layer 17*c*. The electrode conductor layers 221 and 222 have shapes respectively corresponding to those of the electrode conductor layers 211 and 212. When the electrode conductor layers are formed, a conductor also fills the inside of the opening 41 provided in the insulative resin layer 17*c* on a lower side, thereby forming the joining portion 13A (refer to FIG. 2). As a result, the inner circumferential end 21*b* of the first coil layer 210 and an inner circumferential end 22*b* of the second coil layer 220 are joined to each other with the joining portion 13A interposed therebetween. In addition, conductors also fill the openings 42 and 43, thereby forming the conductor layers 191 and 195. As a result, the electrode conductor layer 211 and the electrode conductor layer 221 are connected to each other with the conductor layer 191 interposed therebetween, and the electrode conductor layer 212 and the electrode conductor layer 222 are connected to each other with the conductor layer 195 interposed therebetween. In addition to the conductor layers described above, conductor layers 228 are also formed on an inner side and the periphery of the second coil layer 220. The conductor layers 228 are removed at the production stage for the coil component 1. The forming method for these conductors is similar to the forming method for other layers.

Figure 3D:
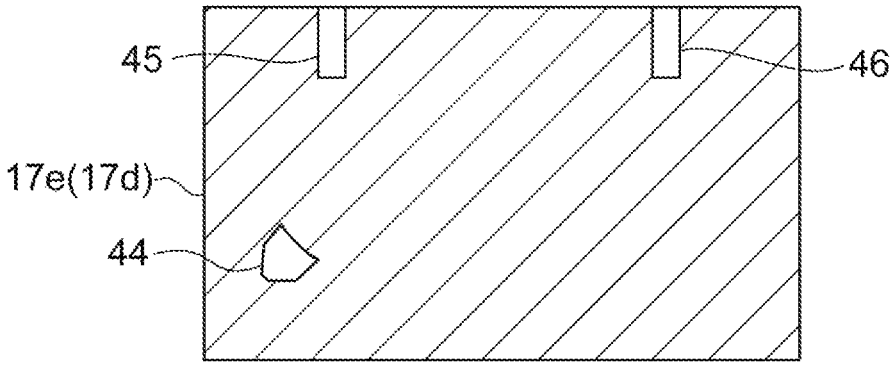

Next, as illustrated in FIG. 3D, an insulative resin is laminated on the upper surface of the insulative resin layer 17*c* such that the second coil layer 220 and the electrode conductor layers 221 and 222 are covered, thereby forming the insulative resin layer 17*d* on the periphery of the second coil layer 220 and the electrode conductor layers 221 and 222, and the insulative resin layer 17*e* on the upper surface thereof. The forming method is similar to that for other insulative resin layers such as the insulative resin layer 17*a*. An opening 44 illustrated in FIG. 3D is formed at a position exposing an outer circumferential end 22*a* of the second coil layer 220. In addition, openings 45 and 46 are formed at positions exposing the electrode conductor layers 221 and 222 respectively.

Figure 4A:
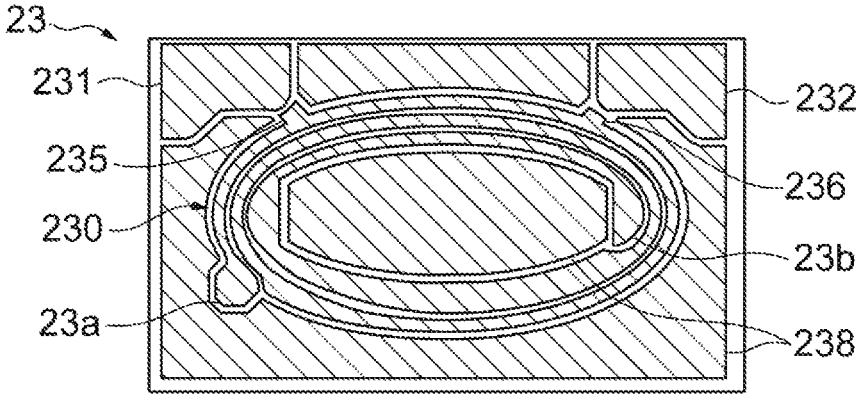
FIGS. 4A, 4B, 4C, 4D are plane pattern diagrams for describing another production step for a coil component.

Next, as illustrated in FIG. 4A, the third coil layer 230 and the electrode conductor layers 231 and 232 included in the third conductor layer 23 are formed on the upper surface of the insulative resin layer 17*e*. The electrode conductor layers 231 and 232 have shapes respectively corresponding to those of the electrode conductor layers 211 and 212. When the conductor layers are formed, a conductor also fills the inside of the opening 44 provided in the insulative resin layer 17*e* on a lower side, thereby forming the joining portion 13B (refer to FIG. 2). As a result, the outer circumferential end 22*a* of the second coil layer 220 and an outer circumferential end 23*a* of the third coil layer 230 are joined to each other with the joining portion 13B interposed therebetween. In addition, conductors also fill the openings 45 and 46, thereby forming the conductor layers 192 and 196. As a result, the electrode conductor layer 221 and the electrode conductor layer 231 are connected to each other with the conductor layer 192 interposed therebetween, and the electrode conductor layer 222 and the electrode conductor layer 232 are connected to each other with the conductor layer 196 interposed therebetween. In addition to the conductor layers described above, conductor layers 238 are also formed on an inner side and the periphery of the third coil layer 230. The conductor layers 238 are removed at the production stage for the coil component 1. The forming method for these conductors is similar to the forming method for other layers.

Figure 4B:
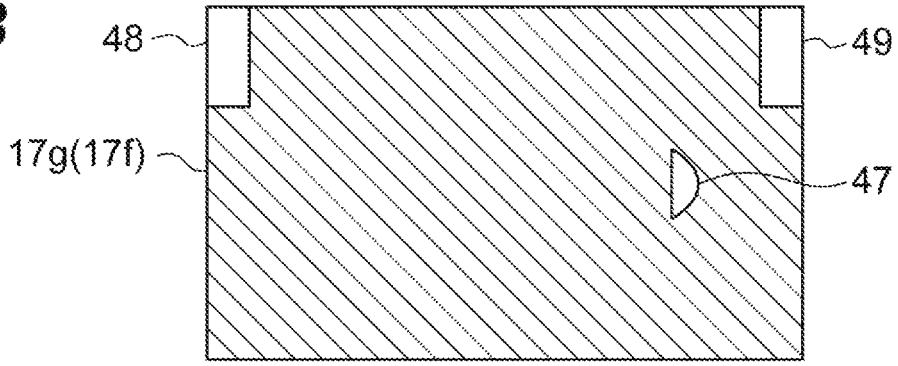

Next, as illustrated in FIG. 4B, an insulative resin is laminated on the upper surface of the insulative resin layer 17*e* such that the third coil layer 230 and the electrode conductor layers 231 and 232 are covered, thereby forming the insulative resin layer 17*f* on the periphery of the third coil layer 230 and the electrode conductor layers 231 and 232, and the insulative resin layer 17*g* on the upper surface thereof. The forming method is similar to that for other insulative resin layers such as the insulative resin layer 17*a*. An opening 47 illustrated in FIG. 4B is formed at a position exposing an inner circumferential end 23*b* of the third coil layer 230. In addition, openings 48 and 49 are formed at positions exposing the electrode conductor layers 231 and 232 respectively.

Figure 4C:
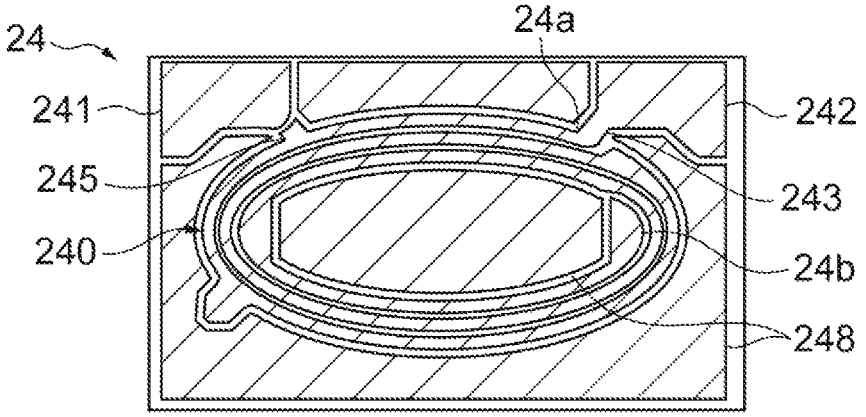
Figure 4D:
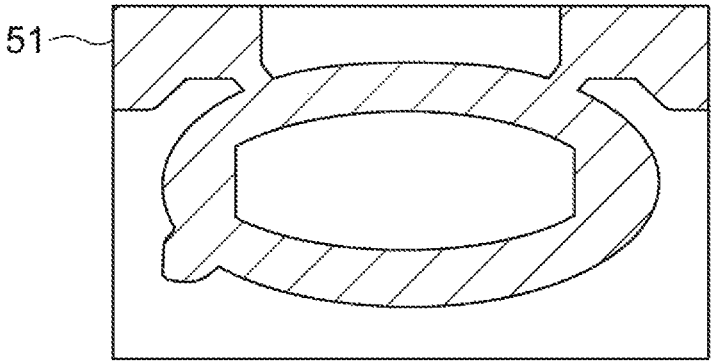

Next, as illustrated in FIG. 4C, the fourth coil layer 240, the electrode conductor layers 241 and 242, and the connection conductor layer 243 included in the fourth conductor layer 24 are formed on the upper surface of the insulative resin layer 17*g*. The electrode conductor layers 241 and 242 have shapes respectively corresponding to those of the electrode conductor layers 211 and 212. The electrode conductor layer 242 provided on an outer side of the outer circumferential end 24*a* of the fourth coil layer 240 is a region functioning as the end portion E2 of the coil 12. In addition, the connection conductor layer 243 is a conductor layer connecting the outer circumferential end 24*a* of the fourth coil layer 240 and the electrode conductor layer 242 to each other. When the conductor layers are formed, a conductor also fills the inside of the opening 47 provided in the insulative resin layer 17*g* on a lower side, thereby forming the joining portion 13C (refer to FIG. 2). As a result, the inner circumferential end 23*b* of the third coil layer 230 and an inner circumferential end 24*b* of the fourth coil layer 240 are joined to each other with the joining portion 13C interposed therebetween. In addition, conductors also fill the openings 48 and 49, thereby forming the conductor layers 193 and 197 is formed. As a result, the electrode conductor layer 231 and the electrode conductor layer 241 are connected to each other with the conductor layer 193 interposed therebetween, and the electrode conductor layer 232 and the electrode conductor layer 242 are connected to each other with the conductor layer 197 interposed therebetween. In addition to the conductor layers described above, conductor layers 248 are also formed on an inner side and the periphery of the fourth coil layer 240. The conductor layers 248 are removed at the production stage for the coil component 1. The forming method for these conductors is similar to the forming method for other layers.

Next, an insulative resin is laminated on the upper surface of the insulative resin layer 17*g* such that the fourth coil layer 240 and the electrode conductor layers 241 and 242 are covered, thereby forming the insulative resin layer 17*h* on the periphery of the fourth coil layer 240 and the electrode conductor layers 241 and 242, and the insulative resin layer 17*i* on the upper surface thereof. The forming method is similar to that for other insulative resin layers such as the insulative resin layer 17*a*. After the insulative resin layers 17*h* and 17*i* are formed, a mask pattern 51 for removing an insulative resin layer is formed in this order in a pattern illustrated in FIG. 4D. The mask pattern 51 is formed to integrally cover the first coil layer 210 to the fourth coil layer 240, and the electrode conductor layers 211, 212, 221, 222, 231, 232, 241, and 242. The insulative resin and the conductor layer in a region not covered with the mask pattern 51 are removed through etching or the like using the mask pattern 51. Therefore, the conductor layers 218, 228, 238, and 248 are also removed at this stage. The magnetic substrate 11 is exposed in the region from which the insulative resin and the conductor layer are removed. In this state, the coil portion C is in a state of being placed on the magnetic substrate 11.

Thereafter, openings for forming the conductor layers 194 and 198 are provided on a surface of the insulative resin layer 17*i*. In addition, the magnetic resin layer 18 is formed by using a method in which the region exposing the magnetic substrate 11 (periphery of the coil portion C) and the surface of the insulative resin layer 17*i* are coated with a resin material and are hardened such that they are covered. Thereafter, the insulative layer 30 is formed, and openings are provided and are filled with conductors which will serve as the lead-out conductors 19A and 19B. Then, the terminal electrodes 20A and 20B are formed on a surface of the insulative layer 30. In a manner as described above, the coil component 1 is formed.

Here, the shapes of the first coil layer 210 to the fourth coil layer 240 and the electrode conductor layers 211, 212, 221, 222, 231, 232, 241, and 242 in the coil component 1 according to the present embodiment will be described in detail.

As described above, in the coil component 1, the electrode conductor layer 211 forming the end portion E1 of the coil 12 is provided outside the first coil layer 210 leading to the outer circumferential end 21*a* of the first coil layer 210 in the first conductor layer 21, and the first coil layer 210 and the electrode conductor layer 211 are connected to each other by the connection conductor layer 213. In addition, the electrode conductor layer 242 forming the end portion E2 of the coil 12 is provided outside the fourth coil layer 240 leading to the outer circumferential end 24*a* of the fourth coil layer 240, and the fourth coil layer 240 and the electrode conductor layer 242 are connected to each other by the connection conductor layer 243.

In this way, the coil component 1 is characterized in that when an electrode conductor layer which will serve as a function layer leading from a plurality of laminated coil layers is provided outside the coil layers and a connection conductor layer is provided between the function layer and the coil layers, even a coil layer, in which no connection conductor layer is required to be provided, has a protrusion portion protruding outward from windings of coils at a position corresponding to the connection conductor layer. The aforementioned term "function layer" indicates a part having a predetermined function when a current flows in the coil 12 as in the electrode conductor layer of the present embodiment. For example, the function layer indicates a part realizing electrical connection between the coil layers, and a part which functions as a terminal connecting the coil and the conductor (for example, the lead-out conductor or the terminal electrode) to each other. In the case of the present embodiment, the electrode conductor layers 211, 212, 221, 222, 231, 232, 241, and 242 functioning as electrode layers of the end portions E1 and E2 of the coil 12 will serve as the function layers. Then, the connection conductor layers 213 and 243 serve as the connection conductor layers which are the conductor layers related to wirings connecting the function layer and the coil layers to each other. Then, protrusion portions are provided at positions corresponding to the connection conductor layers 213 and 243.

Specifically, the end portion E1 is formed by the electrode conductor layer 211 provided at a position protruding outward from the outer circumferential end 21*a* of the first coil layer 210, and the connection conductor layer 213 joining the electrode conductor layer 211 and the first coil layer 210 to each other is provided therebetween. On the other hand, the electrode conductor layers 221, 231, and 241 individually corresponding to the electrode conductor layer 211 are provided in the second coil layer 220 to the fourth coil layer 240, but the conductor layers are not connected to the coil layers. However, in the second coil layer 220 to the fourth coil layer 240, a protrusion portion 225 (refer to FIGS. 2 and 3C), a protrusion portion 235 (refer to FIGS. 2 and 4A), and a protrusion portion 245 (refer to FIGS. 2 and 4C) protruding from an outer circumferential part of each of the coil layers are provided at positions corresponding to the connection conductor layer 213 (positions overlapping the connection conductor layer 213 in a plan view). Each of the protrusion portions 225, 235, and 245 is formed such that insulation with respect to the electrode conductor layers 221, 232, and 242 is sufficiently insured. In order for the protrusion portions 225, 235, and 245 to be corresponding to the connection conductor layer 213, the protrusion portions 225, 235, and 245 are not necessarily in the same shape as the connection conductor layer 213 and need only exhibit a shape similar to that of the connection conductor layer 213 within a range in which insulation with respect to the electrode conductor layer can be sufficiently insured.

In addition, the end portion E2 is formed by the electrode conductor layer 242 provided at a position protruding outward from the outer circumferential end 24*a* of the fourth coil layer 240, and the connection conductor layer 243 joining the electrode conductor layer 242 and the fourth coil layer 240 to each other is provided therebetween. On the other hand, the electrode conductor layers 212, 222, and 232 individually corresponding to the electrode conductor layer 242 are provided in the first coil layer 210 to the third coil layer 230, but the conductor layers are not connected to the coil layers. However, in the first coil layer 210 to the third coil layer 230, a protrusion portion 216 (refer to FIGS. 2 and 3A), a protrusion portion 226 (refer to FIGS. 2 and 3C), a protrusion portion 236 (refer to FIGS. 2 and 4A) protruding from an outer circumferential part of each of the coil layers are provided at positions corresponding to the connection conductor layer 243 (positions overlapping the connection conductor layer 243 in a plan view). Each of the protrusion portions 216, 226, and 236 is formed such that insulation with respect to the electrode conductor layers 212, 222, and 232 is sufficiently insured. In order for the protrusion portions 216, 226, and 236 to be corresponding to the connection conductor layer 243, the protrusion portions 216, 226, and 236 are not necessarily in the same shape as the connection conductor layer 243 and need only exhibit a shape similar to that of the connection conductor layer 243 within a range in which insulation with respect to the electrode conductor layer can be sufficiently insured.

In this way, in the coil component 1 according to the present embodiment, in a case in which a plurality of conductor layers (in the present embodiment, the first conductor layer 21 to the fourth conductor layer 24) are laminated along the axis center of the coil 12, when conductor layers (in the present embodiment, the electrode conductor layers 211 and 242) which will serve as function layers are provided at positions protruding outward from the winding region of the coil layer, and connection conductor layers (in the present embodiment, the connection conductor layers 213 and 243) are provided between the conductor layers and the function layers in a part of conductor layers, the protrusion portion corresponding to the connection conductor layer is provided at a position overlapping the connection conductor layer in a plan view, even in other conductor layers in which no function layer is provided. Since the coil component 1 according to the present embodiment has such a configuration, it is possible to prevent occurrence of disconnection of a conductor wiring around the function layer.

As in the coil component 1, when a plurality of conductor layers including a coil layer are laminated and an insulative resin layer which is formed of an insulative resin and constitutes the covering portion 17 is provided between the laminated conductor layers, there are cases in which flatness of a conductor layer (upper layer of the insulative resin layer may deteriorate due to contraction or the like of the insulative resin layer in the production step, and there are cases in which distortion derived from stress at the time of contraction may occur. In addition, for example, if the thickness of the insulative resin layer increases, unevenness or distortion on the surface of the insulative resin layer further increases. If a conductor layer which will serve as a function layer is provided on an insulative resin layer in which unevenness or distortion has occurred, there is a possibility that disconnection will occur around the connection conductor layer. In addition, even when an insulative resin layer having a significant thickness is formed on the connection conductor layer, there is a possibility that disconnection will occur around the connection conductor layer affected by stress or the like incidental to contraction at the time of hardening the insulative resin.

In contrast, in the coil component 1 according to the present embodiment, when connection conductor layers (connection conductor layers 213 and 243) connecting the coil layer and the function layer to each other are provided in a part among the plurality of conductor layers including the coil layer and the function layer, the protrusion portions (the protrusion portions 225, 235, and 245 and the protrusion portions 216, 226, and 236) corresponding to the connection conductor layers are provided at positions overlapping the connection conductor layer in a plan view, in the conductor layer having no connection conductor layer. Since the coil component has such a structure, unevenness, distortion, or the like incidental to contraction of the insulative resin forming the covering portion 17 can be prevented from being concentrated in the connection conductor layer connecting the coil layer and the function layer. Therefore, disconnection in a conductor layer related to a wiring can be minimized.

In addition, it has been found that unevenness derived from the above-described insulative resin becomes noticeable when the ratio of the thickness of the insulative resin layer between the conductor layers to the thickness of the conductor layer including the coil layer is small. That is, if the ratio of the thickness of the insulative resin layer is small, unevenness appearing on the surface tends to increase at a stage in which the insulative resin layers are laminated on the conductor layer. In a region in which the coil layers are laminated, the shapes of the coil layers become basically and substantially the same as each other. Therefore, the problem of unevenness derived from the insulative resin layer is unlikely to occur on the coil layer. On the other hand, a part around the function layer provided at a position different from the coil layer in a plan view is likely to be affected by unevenness or distortion derived from the insulative resin.

Therefore, risk of occurrence of disconnection derived from unevenness or distortion increases around the connection conductor layer between the coil layer and the function layer.

For example, as in the connection conductor layer 243, when conductor layers (the first conductor layer 21 to the third conductor layer 23) having no connection conductor layer are located below the conductor layer (the fourth conductor layer 24) in which the connection conductor layer is provided, disconnection affected by the insulative resin on a lower side is likely to occur in the connection conductor layer. Therefore, as in the coil component 1, when the conductor layers on a lower side is configured to have the protrusion portions (the protrusion portions 216, 226, and 236), disconnection in the connection conductor layer on an upper side can be suitably prevented. In addition, as in the coil component 1, when all of the conductor layers below the conductor layer having the connection conductor layer are configured to have the protrusion portion, disconnection in the connection conductor layer on an upper side can be more suitably prevented.

On the other hand, there is a high possibility that the connection conductor layer is affected by unevenness or distortion derived from the insulative resin even when the thickness of the insulative resin laminated on the connection conductor layer increases. For example, as in the connection conductor layer 213, when a conductor layer having no connection conductor layers (the second conductor layer 22 to the fourth conductor layer 24) is located above the conductor layer (the first conductor layer 21) in which the connection conductor layer is provided, disconnection affected by the insulative resin on an upper side is likely to occur in the connection conductor layer. In contrast, here, as in the coil component 1, when a conductor layer on an upper side is configured to have the protrusion portions (protrusion portions 225, 235, and 245), disconnection in the connection conductor layer on a lower side can be suitably prevented. In addition, as in the coil component 1, when all of the conductor layers above the conductor layer having the connection conductor layer are configured to have the protrusion portion, disconnection in the connection conductor layer on a lower side can be more suitably prevented.

In addition, in the coil component 1, the protrusion portion is formed to protrude from each of the coil layers 210 to 240. By means of such a configuration, since the conductor of the coil layer practically becomes large, the protrusion portion contributes to reducing the resistance value of the coil layer, and thus characteristics of the coil layer can be improved.

However, the protrusion portion does not have to be configured to be is formed to protrude from the coil layer. In the case of the coil component 1 according to the present embodiment, the protrusion portion may be formed by causing the conductor to protrude from a side of the electrode conductor layer which will serve as the function layer. For example, the protrusion portion 216 may be formed by causing the conductor to protrude from the electrode conductor layer 212. In such a configuration, since the conductor on the function layer side practically becomes large, there are cases in which characteristics of the function layer can be improved.

Hereinabove, the embodiment of the present invention has been described. However, the present invention is not limited to the embodiment described above, and various changes can be made. For example, in the embodiment described above, the number of conductor layers included in the coil 12 need only be two or more, and the number of layers is not particularly limited, thereby being able to be arbitrarily changed. In addition, the protrusion portion below or above the connection conductor layers 213 and 243 does not have to be formed in all of the conductor layers as in the coil component 1 of the embodiment. The protrusion portion may be formed in only a part of conductor layers.

In addition, in the embodiment described above, a case in which the function layer is an electrode conductor layer has been described. However, the function layer may have a different function. Examples of a function layer having a different function include a conductor layer in which a via conductor connected to a wiring layer is formed.

What is claimed is:

1. A coil component comprising:

a plurality of conductor layers that are laminated in a lamination direction, each of the plurality of conductor layers includes a function layer and a coil layer wound around an axis center of the coil component; and a covering portion that is formed of an insulative resin, integrally covers the plurality of conductor layers, and is interposed between conductor layers adjacent to each other; wherein:

the coil layers of the plurality of conductor layers have substantially the same shape in a plan view and the function layers of the plurality of conductor layers have substantially the same shape in the plan view;

at least one of the conductor layers of the plurality of conductor layers has a connection conductor layer connecting the coil layer and the function layer of the at least one of the conductor layers to each other; and at least a second of the conductor layers of the plurality of conductor layers (1) does not have a connection between the coil layer and the function layer of the at least a second of the conductor layers and (2) has a protrusion portion (a) overlapping the connection conductor layer in the plan view, (b) that extends from the coil layer toward the function layer or from the function layer toward the coil layer to reduce a distance between the function layer and the coil layer and (c) corresponds in part to the shape of the connection conductor layer in the plan view.

2. The coil component according to claim 1, wherein the at least a second of the conductor layers is below the at least one of the conductor layers in the lamination direction.

3. The coil component according to claim 2, wherein the at least one of the conductor layers is the only layer of the plurality of conductor layers that includes the connection conductor layer and all other layers of the plurality of conductor layers are below the at least one of the conductor layers and include the protrusion.

4. The coil component according to claim 1, wherein the at least a second of the conductor layers is above the at least one of the conductor layers.

5. The coil component according to claim 1, wherein the protrusion portion protrudes from the coil layer toward the function layer.

6. The coil component according to claim 2, wherein the protrusion portion protrudes from the coil layer toward the function layer.

7. The coil component according to claim 3, wherein the protrusion portion protrudes from the coil layer toward the function layer.

8. The coil component according to claim 4, wherein the protrusion portion protrudes from the coil layer toward the function layer.

9. The coil component according to claim 1, wherein the function layer is located farther from the axis center than the coil layer in a radial direction from the axis center.

* * * * *